US006808029B2

(12) United States Patent
De Lille

(10) Patent No.: US 6,808,029 B2
(45) Date of Patent: Oct. 26, 2004

(54) DRILL RIG ASSEMBLY

(76) Inventor: Zeger De Lille, Krommewege 28, Maldegem (BE), 9990

( * ) Notice: Subject to any disclaimer, the term of this patent is extended or adjusted under 35 U.S.C. 154(b) by 72 days.

(21) Appl. No.: 10/230,382

(22) Filed: Aug. 29, 2002

(65) Prior Publication Data

US 2003/0056986 A1 Mar. 27, 2003

(30) Foreign Application Priority Data

Aug. 31, 2001 (EP) ..... 01870189

(51) Int. Cl.[7] ..... E21B 19/14
(52) U.S. Cl. ..... 175/52; 175/55; 166/77.51
(58) Field of Search ..... 175/52, 85; 166/77.51, 166/77.52, 85.1; 714/22.53, 22.66

(56) References Cited

U.S. PATENT DOCUMENTS

| | | | | |
|---|---|---|---|---|
| 4,570,706 | A | 2/1986 | Pugnet | |
| 6,298,927 | B1 * | 10/2001 | Back | 175/52 |
| 2002/0033277 | A1 * | 3/2002 | Mosing et al. | 175/52 |

FOREIGN PATENT DOCUMENTS

| | | |
|---|---|---|
| BE | 1 006375 | 8/1994 |
| EP | 548 900 A2 | 6/1993 |
| EP | 1 103 695 A2 | 5/2001 |
| WO | WO 99/30000 A1 | 6/1999 |
| WO | WO 00/65193 A1 | 11/2000 |

* cited by examiner

*Primary Examiner*—William Neuder
(74) *Attorney, Agent, or Firm*—Sughrue Mion, PLLC

(57) ABSTRACT

A drill rig assembly comprising a drill mast (3), a storage device (9) for storing a number of drill pipes (1) in a lying position near said drill mast, and a rotary head (5) mounted onto a rotary head trolley assembly (4) which is movable up and down along said drill mast (3). In order to enable a quick, easy and safe transfer of the drill pipes (1) from the storage device (9) to the rotary head (5), this rotary head itself is provided with a clamping assembly (15) arranged to hold a drill pipe with its extremity. The drill rig assembly further comprises means for moving the rotary head (5) with respect to said rotary head trolley assembly (4) to enable the rotary head to clamp with said clamping assembly (15) a drill pipe in the storage device (9) and to position the drill pipe on top of the drill string, substantially in axial alignment thereto. Since no separate drill pipe handling device is necessary, the system can be produced at a lower cost.

14 Claims, 7 Drawing Sheets

DRILL RIG ASSEMBLY

The present invention relates to a drill rig assembly comprising a drill mast, a storage device for storing a number of drill pipes, in particular in a lying position, near said drill mast, a rotary head showing a rotating part arranged to be coupled to one extremity of a drill pipe and a fixed part mounted onto a rotary head trolley assembly which is movable up and down along said drill mast, and means for moving the trolley assembly and the rotary head along the drill mast to feed a string of drill pipes coupled to the rotary head in and optionally back out of the ground.

In practice, the handling of drill pipes from the storage device to the rotary head and vice versa to drill a hole in the ground, in particular a water well, is nearly always performed by means of human labour and sometimes by means of a cable winch. Such a handling of the drill pipes is very labour-intensive and may also be dangerous.

To solve this problem, it has been proposed to place the drill pipes vertically into a carrousel. By rotating the carrousel, the drill pipes can be positioned underneath the rotary head. A drawback of such a system is that only a limited number of drill pipes can be stored in the carrousel and that, due to the vertical position of the drill pipes in the carrousel, the stability of the drill rig is reduced. A further drawback is that loading and unloading the carrousel still requires a lot of time and is also dangerous because the drill pipes have to be manipulated also by hand, a winch or by another lifting device.

In BE-A-1006375, and also in WO 00/65193, a drill pipe handling arm has therefore been proposed which enables to take the horizontal drill pipes from the storage device and position them vertically underneath the rotary head. Such a drill pipe handling device offers a considerable saving of time. A drawback is however that there is still a risk that the drill pipes can fall from the handling arm causing thus a very dangerous situation. The drill pipe handling device is further laborious to operate and especially quite expensive to produce.

An object of the present invention is therefore to provide a new drill rig assembly comprising a drill pipe handling system which can be produced at a lower cost and which enables to transfer the drill pipes relatively quickly, easily and safely from the storage device to the rotary head and vice versa and this without or with a minimum manual intervention.

To this end, the drill rig assembly according to the present invention is characterised in that the rotary head is provided with a clamping assembly provided to hold a drill pipe with its extremity which is arranged to be coupled, in particular screwed, to the rotating part of the rotary head, and in that the drill rig assembly further comprises means for moving the rotary head with respect to said rotary head trolley assembly, which means are arranged, together with the means for moving the rotary head trolley assembly along the drill mast, to enable the rotary head to clamp with said clamping assembly a drill pipe in the storage device and to position the drill pipe on top of the drill string, substantially in axial alignment thereto.

In the drill rig assembly according to the invention, no separate drill pipe handling device has to be provided since the rotary head itself is used to handle the drill pipes. This rotary head has only to be provided with a suitable clamping assembly to hold the drill pipes and the necessary movements of the rotary head to take a drill pipe from the storage device and bring it to the string of drill pipes which are being drilled into the ground. Apart from the usual movement up and down along the drill mast, a pivotal movement of the rotary head with respect to the trolley assembly may for example be sufficient. Compared to a separate drill, pipe handling device, the system according to the invention requires less costs, in particular since a large part of the required movements of the rotary head are already available in the conventional drill rigs. Moreover, no transfer of the drill pipes from the drill pipe handling device to the rotary head or vice versa is required any more, resulting not only in a less complex system but also in a reduction of the operating time and a gain in security considering the fact that the drill pipes are not handled by hand and are always tight to the drill head.

In a preferred embodiment of the drill rig assembly according to the invention, said clamping assembly comprises first and second mutually co-operating clamping means to clamp the drill pipe between them, the first clamping means comprising a tubular portion arranged to partially enclose the extremity of the drill pipe to be clamped therein and showing a longitudinal slit enabling said extremity of the drill pipe to be inserted laterally into this tubular portion, said tubular portion in particular enclosing the extremity of the drill pipe over an angle of at least 180°, preferably over an angle of more than 180°.

An advantage of this embodiment is that the extremity of the drill pipes can simple be inserted into the tubular portion of the first clamping means by lowering the rotary head, having the slit in this tubular portion directed downwards, onto the extremity of the drill pipe.

Other particularities and advantages of the invention will become apparent from the following description of some particular embodiments of the drill rig assembly according to the present invention. The reference numerals used in this description relate to the annexed drawings wherein:

FIG. 6 is a bottom view on the first clamping means of the rotary head illustrated in FIGS. 4 and 5 having the drill pipe elevator removed there from;

The drill rig assembly illustrated in the figures is in particular intended to drill water wells in the ground down to a depth which is usually comprised between 50 and 500 m. When the drill bit has reached this depth, the string of drill pipes 1 is withdrawn from the hole and a casing is lowered therein. In some cases, the drill pipes may however be casings which are left in the ground. The drill rig can further be designed for other applications such as for example for petrol drilling, ground investigation, core-, anchor-, grouting-, pile-, well-, overburden, rock-drilling, underwater drilling, hammer drilling with down the hole hammer or hammer on the head of the drill string, high frequency drilling, percussion drilling, horizontal and vertical directional drilling, jet grouting, double head drilling, direct and reversed drilling, etc.

Figure 1:
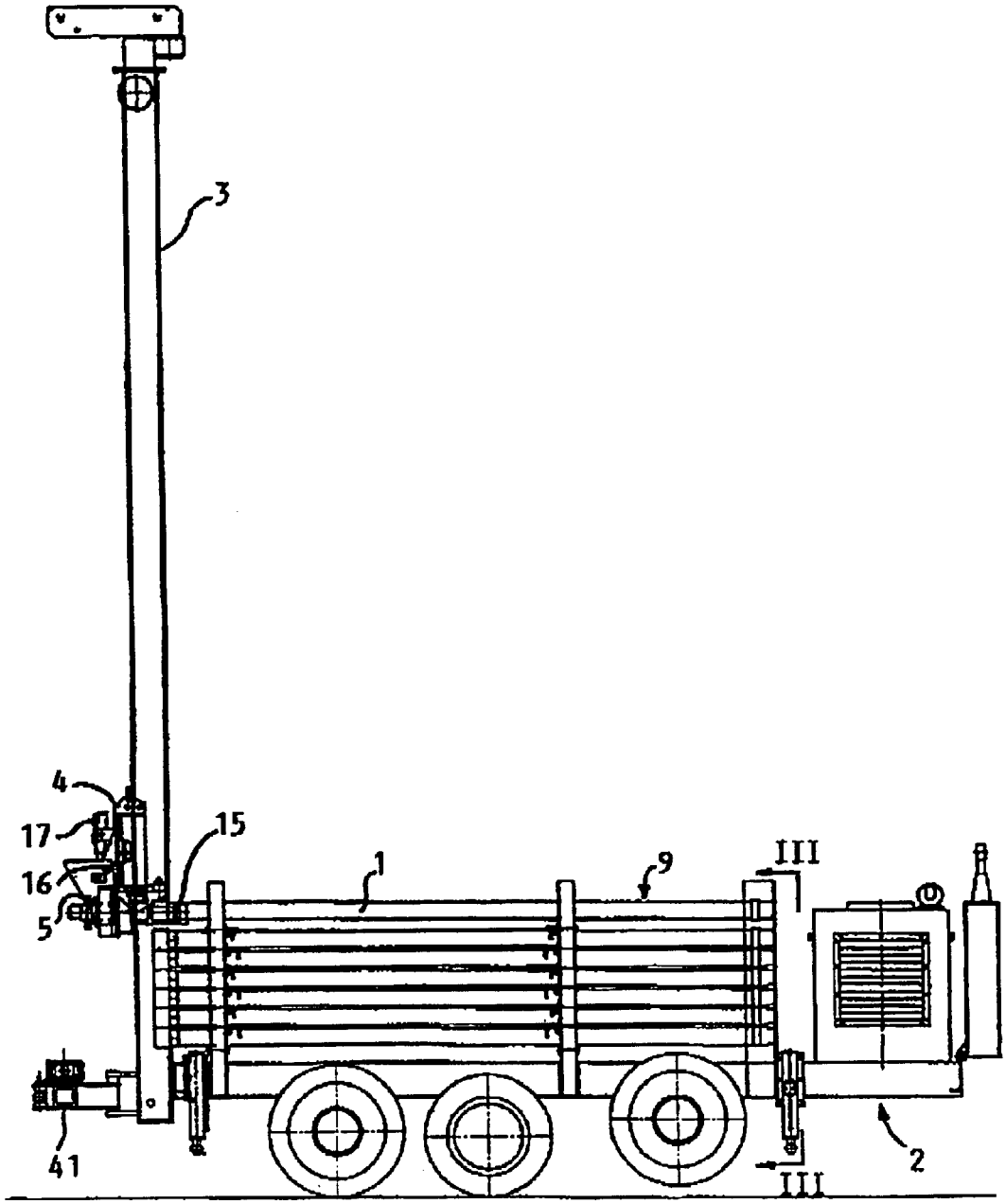
FIG. 1 shows a schematic side view of a drill rig assembly according to the invention having its rotary head lowered down to the storage device to take a drill pipe.

As shown in FIG. 1, the drill rig may comprise a trailer 2 but it may also be mounted onto an entire truck, on a crawler undercarriage or a slide frame. It further comprises a drill mast 3 which can be brought into an upright position, usually by means of one or more hydraulic cylinder-piston mechanisms which have not been illustrated in the figures. In some applications, the mast can also be positioned under an angle. In other applications, the mast can further be fixed to the frame of the drill rig and brought into drilling position by moving the complete drill rig such as in the case of a horizontal directional drill rig. The mast 3 forms a guide for a rotary head trolley assembly 4 which is movable up and down along the mast and which carries a rotary head 5. This rotary head 5 comprises a rotating part 6 arranged to be coupled to one extremity 7 of a drill pipe 1 and a fixed part 8 by means of which the rotary head 5 is mounted onto the rotary head trolley assembly 4. By lowering the rotary head trolley assembly 4 along the mast 3 whilst the rotating part 6 and the drill pipe 1 coupled thereto are rotating, the drill pipe can be lowered into the ground, optionally by exerting or not an additional pull down or hold back force onto the rotary head. When the hole is made in the ground, the string of drill pipes can be hoisted by means of a winch or by screwing the drill pipes to the drill head and then hoisting the drill head by a conventional pull-up system for drill rigs, which has not been illustrated but which is known per se.

The drill rig assembly according to the invention further comprises a storage device 9 for storing a number of drill pipes 1 in a lying position near the mast 3. In the embodiment illustrated in the drawings, this storage device 9 is provided onto the trailer 2. However, it is also possible to provide an independently movable storage device, mounted for example on a second trailer, which can be positioned behind the drill rig. Optionally, the storage device may be movable by itself, for example in a vertical direction or even rotated to a vertical position, to reduce the movements which have to be performed by the rotary head to take a drill pipe from the storage device or to place a drill pipe back therein.

Figure 3:
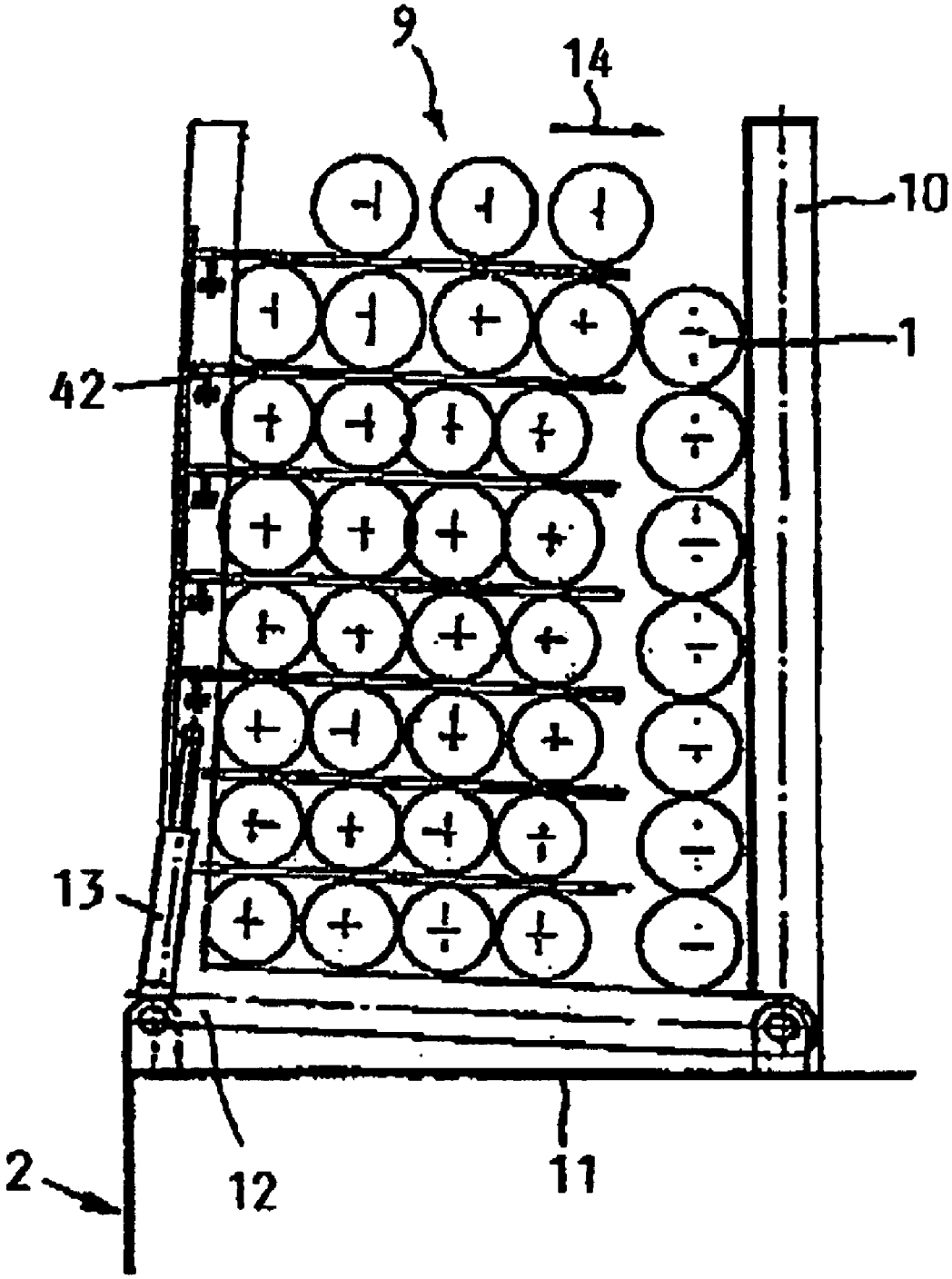
FIG. 3 shows a front view, according to arrows III—III in FIG. 1, on one of the drill pipe storage devices of the drill rig assembly illustrated in that figure.

In its simplest embodiment, the storage device 9 may simply consist of a support provided with lateral uprights between which the drill pipes can be stacked. FIG. 3 shows however a preferred embodiment of the storage device which has been described already in BE-A-10063375. In short, this storage device comprises uprights 10 mounted on the top 11 of the trailer 2 and L-shaped arms 12, one leg of which carries the drill pipes and is hinge connected at its free extremity to an upright 10. To the other, upstanding leg of the L-shaped arms 12, horizontal bars 42 are attached to support different layers of drill pipes 1. A cylinder-piston mechanism 13 enables to raise the L-shaped arms 12 so that the drill pipes roll to one side, according to arrow 14, and can thus be taken out of the storage device 9. For re-filling the storage device, the arms 12 can be lowered so that the drill pipes will roll to the opposite side. It will be clear that instead of this preferred storage device, other storage devices can be used for example a storage device wherein a hydraulic cylinder or a spring is used to push the drill pipes to one predetermined position or even a storage device wherein the drill pipes are to be positioned manually into this position.

Figure 2:
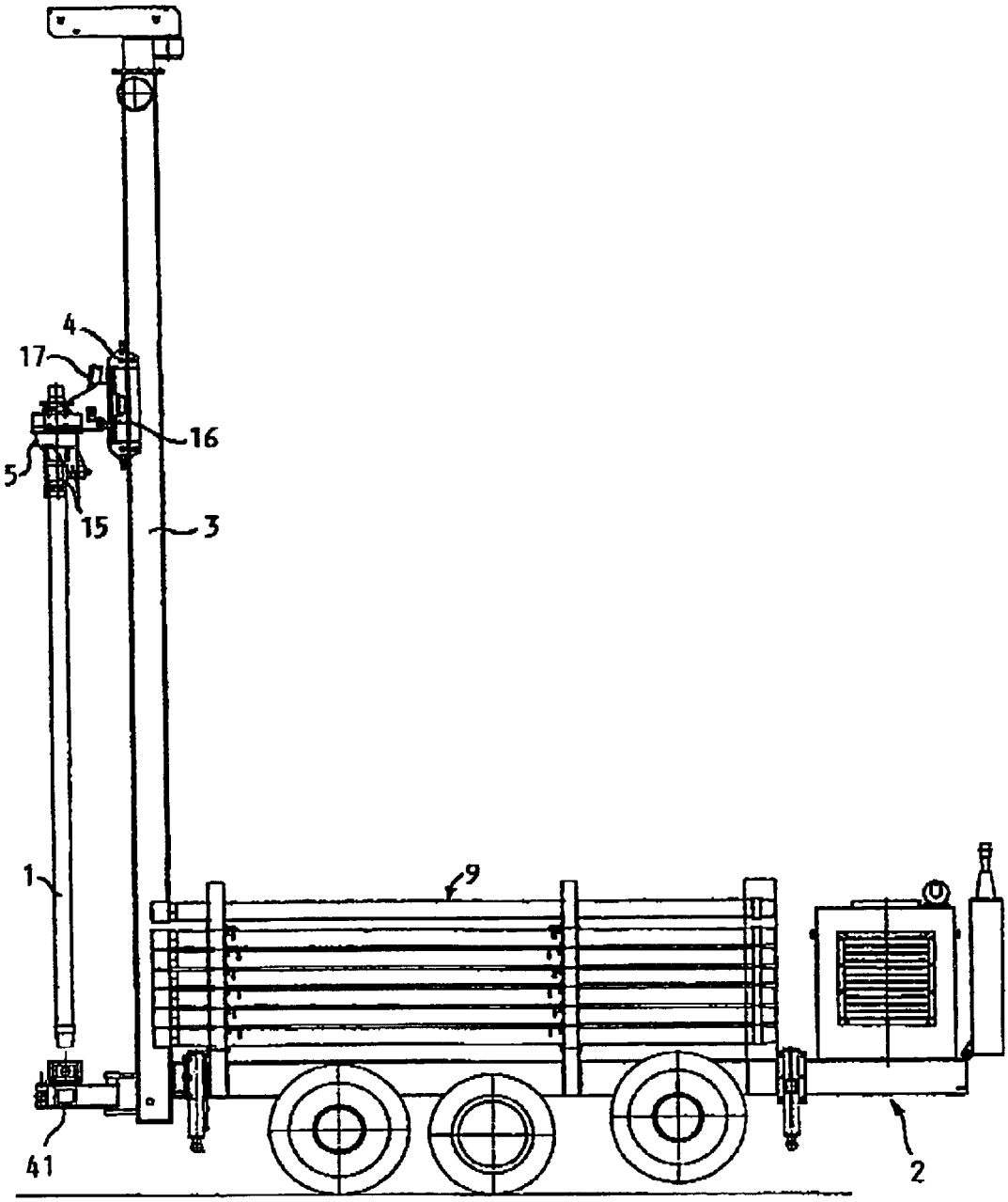
FIG. 2 is a view analogous to the view illustrated in FIG. 1 but showing the rotary head in its uppermost position and the drill pipe clamped therein in axial alignment with the string of pipes drilled into the ground.

An essential feature of the drill rig according to the invention is that the rotary head 5 is provided with a clamping assembly 15 by means of which the rotary head 5 can take a drill pipe 1 from the storage device 9 and position it on top of the drill pipe which has previously been drilled into the ground, in axial alignment to the drill string. FIG. 1 shows the position wherein the rotary head 5 has been lowered by means of the rotary head trolley assembly 4 along the mast 3 down to the drill pipes 1 in the storage device 9. To enable the clamping assembly 15 to take a drill pipe 1, the rotary head has been rotated over an angle of about 90° around a pivot 16 with respect to the rotary head trolley assembly 4, more particularly by means of the hydraulic cylinder-piston mechanism 17 interposed between the rotary head 5 and the rotary head trolley assembly 4. To bring the drill pipe held in the clamping assembly 15 of the rotary head to the upward position illustrated in FIG. 2, the rotary head 5 can first be moved upward holding the drill pipe 1 in a substantially horizontal position. Subsequently, the rotary head 5 and the drill pipe 1 can be rotated back over an angle of about 90° to the upward position. Preferably, the rotary head 5 can not only pivot with respect to the rotary head trolley assembly 4 but a side shift mechanism is preferably provided so that it can also be moved transversally with respect to the rotary head trolley assembly. Such a hydraulic operated "side shift" system is common on most drill rigs. The known "side shift" is used to clear the bore hole so as to allow to lower a charge in the centre of the bore hole with a winch. Due to the transversal movement of the rotary head, the lateral side of the storage device where the drill pipes have to be loaded or unloaded from this storage device, does not have to be positioned exactly underneath the rotary head. Moreover, two storage devices can be provided, one on each side of the mast 3, and, as explained hereafter, the rotary head can be moved horizontally to insert the upper extremity of a drill pipe which has to be build out into the clamping assembly 15.

Figure 4:
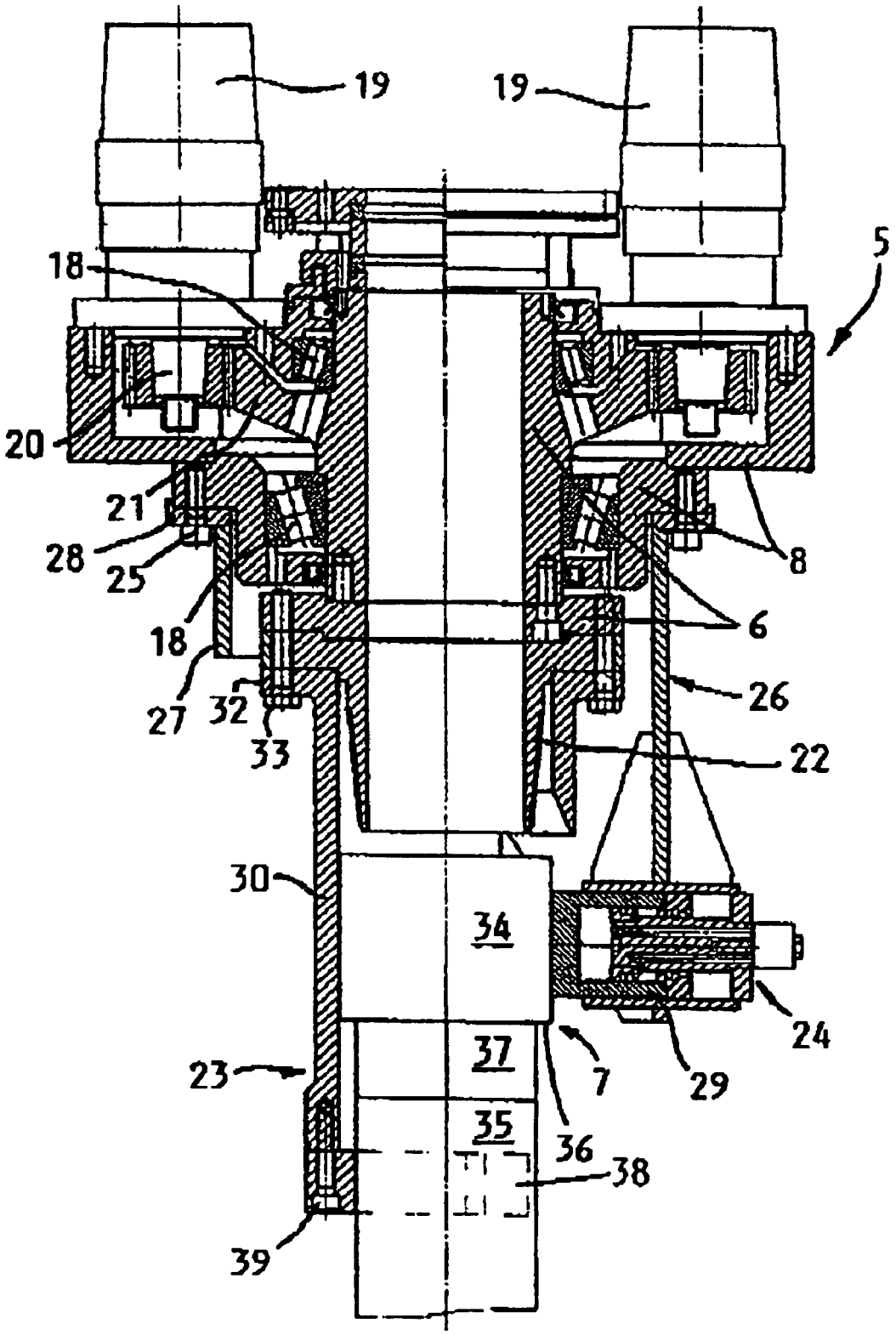
FIG. 4 is, on a larger scale, a cross-sectional view through the rotary head of the drill rig assembly illustrated in FIG. 1, having a drill pipe held within the clamping assembly of the rotary head.

FIG. 4 shows in greater detail the rotary head with its clamping assembly according to a preferred embodiment of the invention. The main part of this rotary head, i.e. the rotary head devoid of its clamping assembly 15 is already known per se and will therefore only be described in broad outline. The illustrated rotary head is more particularly sold by Fraste S.p.A. under the denomination "R12D100 rotary head". As mentioned already hereabove this rotary head 5 comprises a fixed part 8 and a rotating part 6 rotating onto bearings 18 within the fixed part 8. The fixed part is provided with two hydraulic motors 19 driving the rotating part in rotation by means of their drive pinions 20 engaging a main pinion 21 on the rotating part. The rotating part 6 is at the bottom provided with a so-called wear sub 22 showing an external screw thread onto which the extremity 7 of the drill pipe 1 can be screwed to fix the drill pipe to the rotary head before drilling this drill pipe into the ground.

Figure 11:
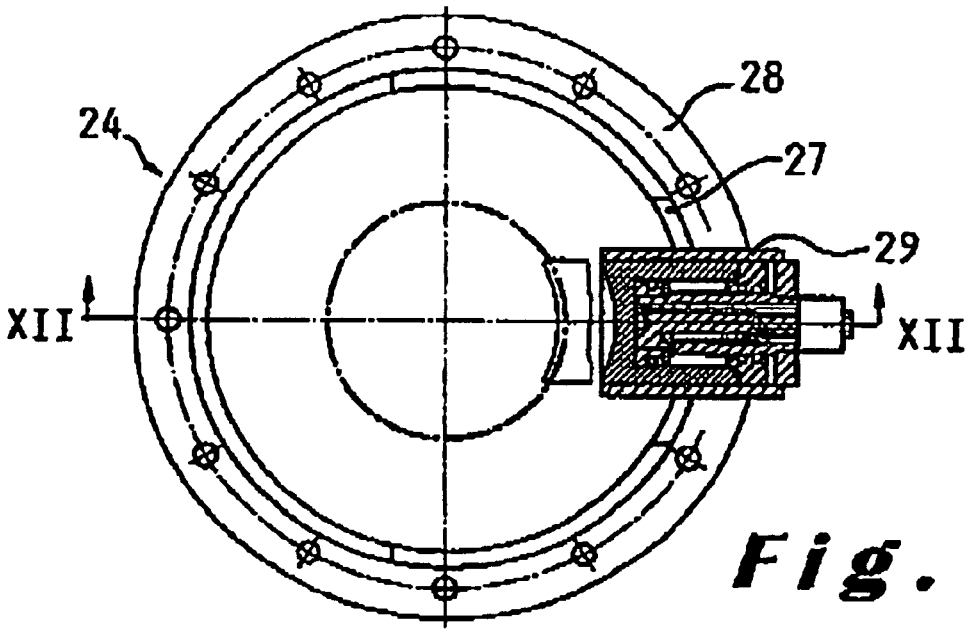
FIG. 11 is a bottom view on the second clamping means of the rotary head illustrated in FIGS. 4 and 5, showing the clamping element in cross-section.
Figure 12:
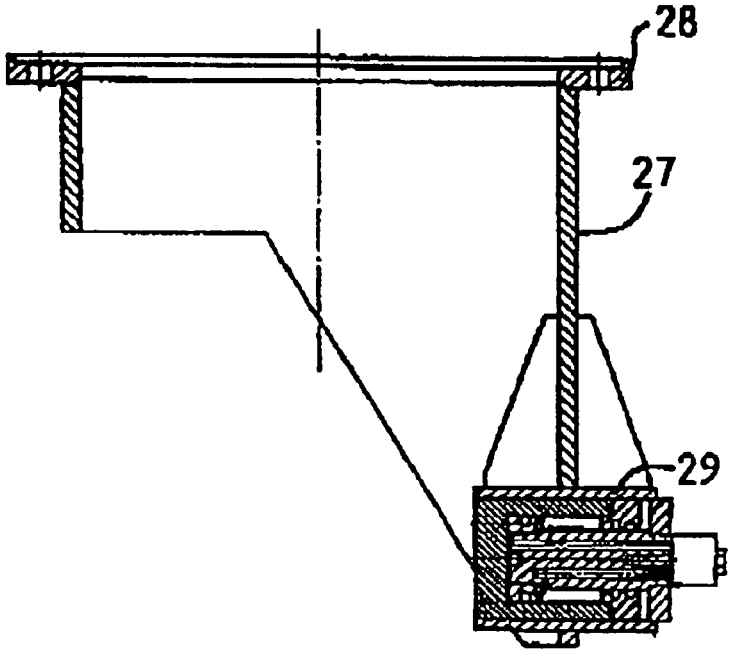
FIG. 12 is a sectional view according to arrows XI—XI through the second clamping means illustrated in FIG. 11.

The clamping assembly 15 provided on the rotary head comprises first and second clamping means 23 and 24 which co-operate with one another to clamp the drill pipe 1 between them. The second clamping means 24 are illustrated in greater detail in FIGS. 11 and 12. They are fixed by means of screws 25 to the fixed part of the rotary head and comprise a support structure 26, formed by a tube 27 provided with a flange 28, and a clamping element 29, formed by a hydraulic cylinder-piston mechanism, arranged to clamp the extremity 7 of the drill pipe 1 against the first clamping means 23. Instead of a hydraulic cylinder-piston mechanism, it is also possible to provide a mechanical clamping mechanism, for example a screw or a lever mechanism, which may be driven by a motor or which may be actuated by hand. In order to enable the second clamping means 24 to engage a drill pipe 1 from the storage device 9 by simply lowering the clamping means onto the extremity 7 of the drill pipe, i.e. without requiring a sliding motion of the clamping means along the drill pipe in the longitudinal direction thereof, a substantial portion of the tube 27 has been cut away as illustrated in the figures.

Figure 6:
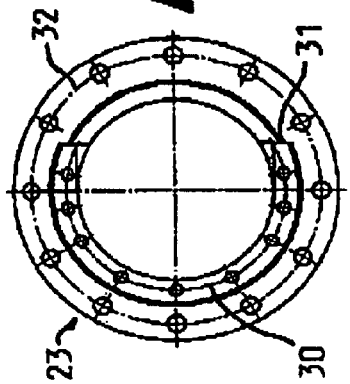
Figure 7:
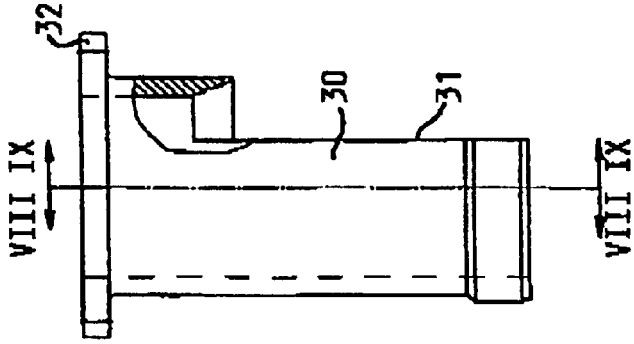
FIG. 7 is a side elevational view on the first clamping means of the rotary head illustrated in FIGS. 4 and 5.
Figure 9:
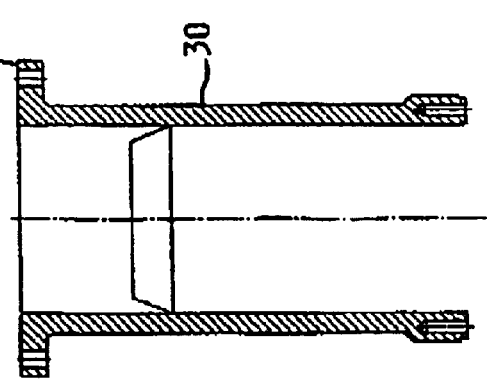
FIGS. 8 and 9 are sectional views according to arrows VIII—VIII and IX—IX respectively in FIG. 7.
Figure 8:
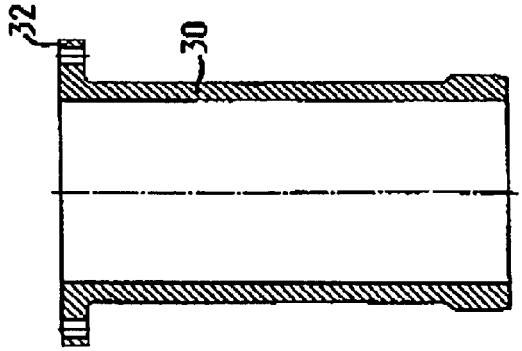

The first clamping means 23 of the clamping assembly illustrated in the figures comprise a tubular portion 30 arranged to partially enclose the extremity 7 of the drill pipe to be clamped therein. The drill pipe is only partially enclosed by the tubular portion 30 due to the fact that it shows a longitudinal slit 31 having a width which is at least as large as the diameter of the extremity 7 of the drill pipe 1 so that this extremity 7 can easily be inserted laterally into the tubular portion 30, especially when the drill pipe is lying in the storage device and the rotary head is lowered thereover to the position shown in FIG. 1. The slit 31 is preferably made as small as possible in order to limit the reduction of the strength of the tubular portion to a maximum. In this respect, the tubular portion 30 preferably encloses the extremity 7 of the drill pipe 1 over an angle of at least 180°, more preferably over an angle which is even greater than 180°. As illustrated in FIG. 6, this can be achieved by reducing the wall thickness of the tubular portion towards the edge of the longitudinal slit 31. Above the extremity of the drill pipe when it is clamped between the clamping means 23, 24, the slit 31 ends and the first clamping means are formed by the entire tubular portion giving the maximum strength. On top, the tubular portion 30 is provided with an outward flange 32 enabling to fix the first clamping means 23 by means of screws 33 to the rotating part 6 of the rotary head 5.

The tubular portion 30 of the first clamping means 23 has preferably in inner diameter corresponding substantially to the outer diameter of the extremity 7 of the drill pipe which is to be clamped therein. In this way, the drill pipe will automatically be centred in the clamping assembly. Moreover, the tubular portion 30 shows a longitudinal axis which substantially coincides with the rotation axis of the rotating part 6 of the rotary head. The drill pipe is therefore automatically in the right position to be fixed to the wear sub 22 of the rotary head.

Referring to FIG. 4, the drill pipes which can be used in the drill rig according to the invention have an extremity 7 composed of an internally threaded tool joint 34 followed by a recessed portion forming an outer collar 36 at the transition between both. Preferably, the recessed portion 35 has a cylindrical outer surface, except adjacent the tool joint where the recessed portion 35 preferably shows a polygonal, in particular a hexagonal, outer surface 37.

Figure 10:
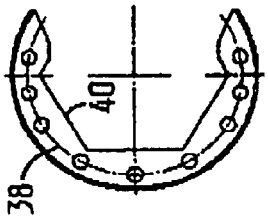
FIG. 10 is a bottom view on the drill pipe elevator to be mounted against the bottom of the first clamping means illustrated in FIGS. 6 to 9.

Underneath the tubular portion 30, the first clamping means 23 are provided with a drill pipe elevator 38 which is fixed by means of screws 39 to the bottom of the tubular portion 30 and which protrude inwards with respect to the inner surface of the tubular portion 30 to engage the drill pipe underneath the collar 36 so that the drill pipe can be lifted by means of this drill pipe elevator. As illustrated in FIG. 10, the drill pipe elevator 38 is generally horseshoe-shaped showing an opening to enable the recessed portion 35 of the drill pipe, in particular the portion thereof situated underneath the polygonal surface 37, to be inserted laterally in the drill pipe elevator 38 when laterally inserting the drill pipe 1 into the first clamping means 23. The drill pipe elevator does therefore not prevent the extremity 7 of the drill pipe to be inserted laterally into the tubular portion 30, especially when the drill pipe is lying in the storage device and the rotary head is lowered thereover in the position shown in FIG. 1.

In the embodiment illustrated in the figures, the drill pipe elevator is not only used to lift a drill pipe but also to rotate the drill pipe, in particular to unscrew it from a previous drill pipe in the drill string. The drill pipe elevator 38 shows more particularly a polygonal inner surface 40 corresponding to the polygonal outer surface 37 in the recessed portion 35 of the drill pipe. The polygonal inner surface 40 of the drill pipe elevator extends over such an angle around the polygonal outer surface 37 of the drill pipe 1 that the drill pipe is prevented from falling laterally out of the drill pipe elevator. As explained hereabove, the drill pipe elevator has however such an opening that the cylindrical portion of the drill pipe underneath the polygonal surface 37 can be inserted in the drill pipe elevator 38.

The drill rig illustrated in the figures can now be used in the following way to drill a hole in the ground. To take a drill pipe 1 from the storage device 9, the rotary head 5 can be pivoted and lowered along the mast 3 to the position illustrated in FIG. 1. In this position the tube 27 of the second clamping means 24 is directed with its cut away portion downwards and the rotating part 6 of the rotary head 5 is rotated so that also the longitudinal slit 31 in the tubular portion 30 of the first clamping means 23 is directed downwards. By further lowering the rotary head, the tubular portion 30 of the first clamping means 23 will partially enclose the extremity 7 of the drill pipe and will push any neighbouring drill pipe aside and centre the drill pipe in the tubular portion 30. In order to enable this movement, the rotary head is positioned in the longitudinal direction of the drill pipe in such a manner that the drill pipe elevator 38 is situated above the cylindrical portion of the recessed portion 35 of the drill pipe 1.

In a next step, the rotating part 6 of the rotary head 5 is rotated over about 180° and the clamping element 29 is actuated to clamp the extremity 7 of the drill pipe, more particularly the tool joint 34, between this clamping element 29 and the tubular portion 30 of the first clamping means 23. This situation has been illustrated in FIG. 4. The rotary head 5 can then be raised along the mast 3 holding the drill pipe 1 in a substantially horizontal position. Subsequently, the rotary head 5 can be pivoted over about 90° to a substantially vertical position. When drilling inclined instead of vertical borings, the rotary head has of course to be pivoted over the corresponding angle. Moreover, pivoting the rotary head can possibly already be started when raising it along the mast. To rotate the first clamping means over the right angle with respect to the fixed part of the rotary head, a positioning system, which can be a magnetic approach switch can be provided to help the operator to position the tubular portion 30 of the first clamping means in the right position.

In case the drill pipe 1 is the first drill pipe, having a drill bit at its lower extremity, it will be lowered into a clamping device 41 at the bottom of the drill rig above the boring to be drilled. If necessary, the rotary head can be moved horizontally with respect to the rotary head trolley assembly 4 to centre the drill pipe above the clamping device 41. The first drill pipe 1 is then clamped in the clamping device 41, the clamping assembly 15 of the rotary head 5 is released, and the rotary head 5 is lowered and rotated to screw the wear sub 22 in the tool joint 34 of the drill pipe. Subsequently, the clamping device 41 is released and the drill pipe is drilled in the ground.

In case the drill pipe 1 is not the first drill pipe, this drill pipe will be lowered into the tool joint 34 of the drill pipe which has previously been drilled into the ground and which is held in the clamping device 41. Just as for the first drill pipe 1, the clamping assembly 15 of the rotary head 5 is released and the rotary head is lowered until the wear sub engages the tool joint 34 of the drill pipe and the lower extremity of this drill pipe is inserted into the tool joint of the previous drill pipe. When subsequently rotating the rotary head 5, the wear sub 22 will be screwed in the tool joint of the drill pipe 1 and, at the same time, the lowermost extremity of the drill pipe 1 will be screwed in the previous drill pipe. After releasing the clamping device 41, the entire drill string can be drilled further into the ground.

To take a further drill pipe, the uppermost extremity of the drill string is clamped in the clamping device 41, the rotary head is rotated to unscrew the wear sub 22, the rotary head 5 is moved somewhat upwards to clear the wear sub 22 from the tool joint 34, then turned into a position so that the slit 31 in the first clamping means 23 is directed in such a direction that the drill head can be moved sidewards by means of the side shift, preferably already towards the drill pipe storage, raised further, pivoted over about 90° to be parallel to the axis of the drill pipe to be taken out of the storage device and lowered again onto this drill pipe, after having turned the slit 31 in the first clamping means and the drill pipe elevator 38 with its opening downwards. Once the drill pipe tool joint fits into the tubular portion 30 and the cylindrical section of the drill pipe in elevator 38 then the drill head wear sub 22 and the first clamping means 23 are turned over about 90° to position the drill pipe between the two clamping means 23 and 24. Then the clamping tool 29 is actuated fixing so the drill pipe to the drill head. Thereafter, the drill pipe can be elevated in and positioned parallel to the drilling direction during the hoisting of the drill head, then the drill head with the drill pipe is moved to the drill centre and the new drill pipe screwed into the previous one. Therefore the new drill pipe is positioned on the one in the clamping device 41, then the clamping element 29 de-actuated and then by turning the drill head with the wear sub 22 the two drill pipes can be screwed together.

In a variant embodiment, when no side shift mechanism would be provided, it is also possible to remove the clamping means from the drill pipe which has been drilled in the ground by pivoting the rotary head around the pivot 16. In both embodiments, building in the different drill pipes can thus be achieved very quickly and safely without manual intervention.

Figure 5:
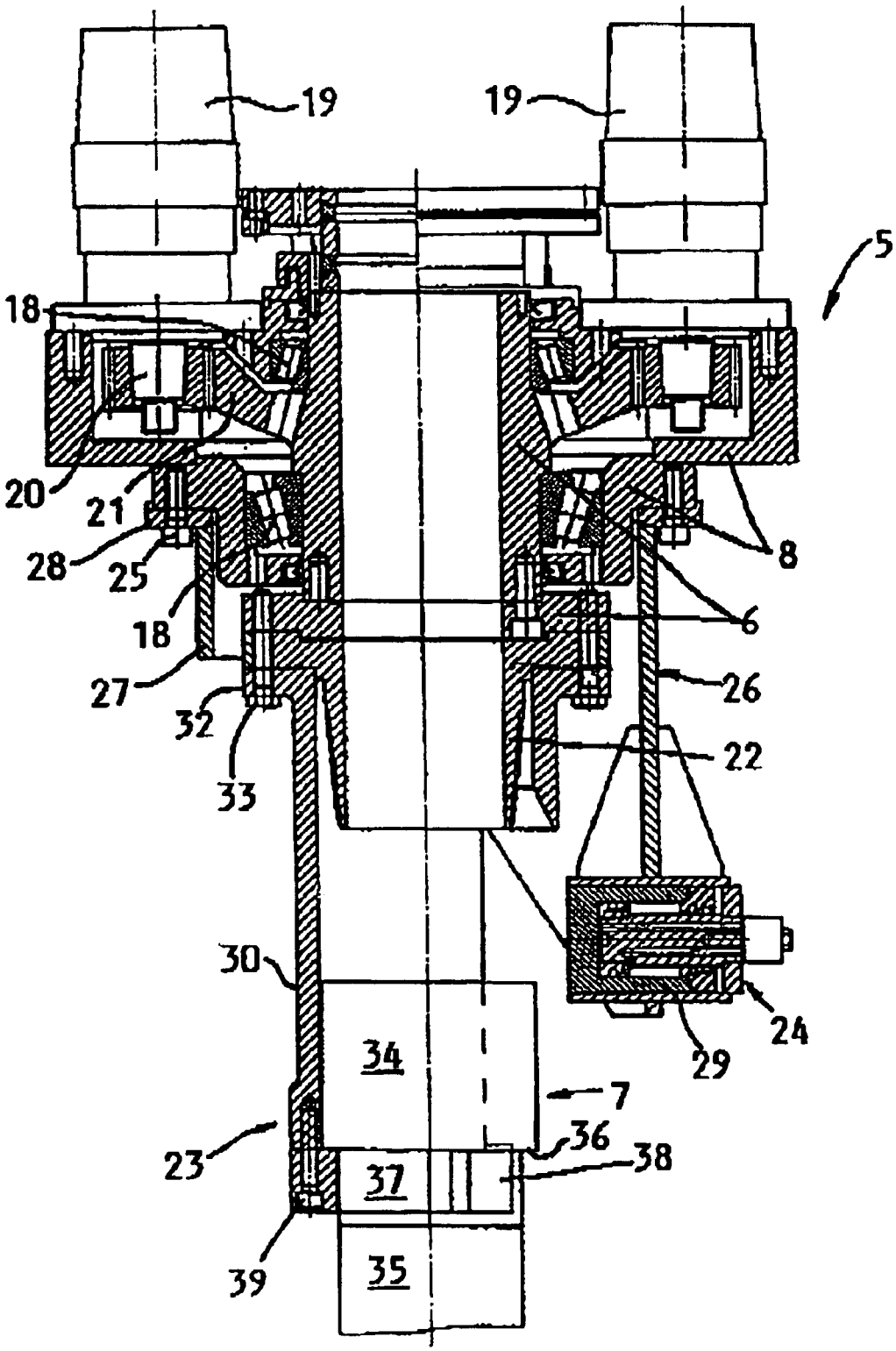
FIG. 5 is a view analogous to FIG. 4 but showing the drill pipe held in the drill pipe elevator instead of in the clamping assembly.

Once the required depth has been reached or another cutting tool has to be build in, the uppermost drill pipe of the drill string is clamped in the clamping device 41, the rotary head 5 is rotated to unscrew the wear sub 22 out of the tool joint 34 and the rotary head is hoisted and optionally rotated somewhat until the drill pipe elevator 38 fits around the polygonal surface 37 in the recessed portion 35 of the drill pipe (see FIG. 5). The clamping device 41 is released and the drill pipe is hoisted, without closing the clamping assembly 15 in the rotary head 5, by means of the drill pipe elevator 38. Once the tool joint of the next drill pipe passes through the clamping device 41, hoisting of the drill string is stopped and this next drill pipe is fixed in the clamping device 41. In this stage, the upper drill pipe can be unscrewed from the next drill pipe by rotating the rotary head 5. Subsequently the rotary head is lowered somewhat so that the drill pipe elevator extends around the cylindrical portion of the drill pipe, the rotary head, more particularly the rotating part 6 thereof, is rotated so that the slit 31 in the first clamping means is directed towards the clamping element 29 of the second clamping means 24 and this clamping element is actuated to clamp the drill pipe in the clamping assembly 15 as illustrated in FIG. 4.

In this position, the drill pipe is strongly held in the clamping assembly 15 and the rotary head can be lifted somewhat further until it can be pivoted over 90° and lowered to place the drill pipe in horizontal position in the storage device 9. The clamping assembly 15 can then be released and the rotary head rotated so that the slit 31 in the first clamping means is directed downwards.

To build out the next drill pipe, the rotary head has simply to be lifted somewhat, pivoted and lowered or raised so that the drill pipe elevator 38 is at the level of the cylindrical surface of the recessed portion 35 of the drill pipe. The rotary head is then moved so that the extremity 7 of the drill pipe is inserted into the first clamping means. This movement can be done in a longitudinal direction away from the drill rig. However, by rotating the rotary head horizontally over about 90°, the extremity 7 of the drill pipe can also be inserted in the first clamping means be a transverse movement of the rotary head, i.e. in the same direction as for moving the rotary head transversally to the storage device. Indeed, as it appears from FIG. 4, the portion cut away from the tube 27 of the second clamping means 24 may be large enough to allow a lateral insertion of the drill pipe in the tubular portion 30 of the first clamping means 23 without having to rotate this tubular portion 30 over 180°. In case no side shift mechanism would be provided, it is further also possible to insert the drill pipe into the clamping means by pivoting the rotary head around the pivot 16. Subsequently, the same steps as described herebefore can be performed to build out the drill pipe, i.e. raising the rotary head so that the drill pipe elevator 38 is situated around the polygonal portion 37 and engages the collar 36, releasing the clamping device 41, hoisting the drill string, clamping the next drill pipe, unscrewing both drill pipes, lowering the rotary head somewhat, clamping the drill tube in the clamping assembly of the rotary head and pivoting and lowering the drill pipe into the storage device 9. All of these steps can be performed quickly and safely without any manual intervention.

For a person skilled in the art, it will be clear that the above described drill rig allows also to build in quickly another cutting tool, for example when reaching a rock layer after having drilled through a softer layer. Indeed, as explained hereabove, the string of drill pipes can be build out very quickly. For building them again in, having another cutting tool attached to the lowermost drill pipe, the opposite procedure can simply be followed. It should be noted that during this procedure, in contrast to the drilling operation, the different drill pipes do not have to be fixed to the wear sub but can simply be screwed together and lowered into the bore hole while being held only by the drill pipe elevator. In this way, a lot of time can be saved.

Based on the above description of a preferred embodiment of the drill rig according to the invention, it will be clear that many modifications can be applied thereto without falling outside the scope of appended claims.

What is claimed is:

1. A drill rig assembly comprising a drill mast, a storage device for storing a number of drill pipes near said drill mast, a rotary head having a rotating part arranged to be coupled to one extremity of a drill pipe and a fixed part mounted onto a rotary head trolley assembly which is movable up and down along said drill mast, and means for moving the trolley assembly and the rotary head along the drill mast to feed a string of drill pipes coupled to the rotary head in and optionally back out of the ground, said rotary head being provided with a clamping assembly provided to hold a drill pipe with an extremity thereof which is arranged to be coupled to the rotating part of the rotary head, and the drill rig assembly further comprising means for moving the rotary head with respect to said rotary head trolley assembly, which means are arranged, together with the means for moving the rotary head trolley assembly along the drill mast, to enable the rotary head to clamp with said clamping assembly a drill pipe in the storage device and to position the drill pipe on top of the drill string, substantially in axial alignment thereto, said clamping assembly comprising first and second mutually co-operating clamping means to clamp the drill pipe between them, the first clamping means comprising a tubular portion arranged to partially enclose the extremity of the drill pipe to be clamped therein and having a longitudinal slit enabling said extremity of the drill pipe to be inserted laterally into this tubular portion.

2. The drill rig assembly according to claim 1, wherein said storage device is arranged to store said number of drill pipes in a lying position and wherein said means for moving the rotary head with respect to said rotary head trolley assembly comprise a pivot enabling the rotary head to pivot over an angle substantially equal to the angle formed by the string of drill pipes and the drill pipes stored in the storage device.

3. The drill rig assembly according to claim 1, wherein said tubular portion of the first clamping means is arranged to enclose the extremity of the drill pipe over an angle of at least 180°.

4. The drill rig assembly according to claim 1, wherein said tubular portion has an inner diameter corresponding substantially to the outer diameter of the extremity of the drill pipe to be clamped therein.

5. The drill rig assembly according claim 1, wherein the extremity of the drill pipe arranged to be coupled to the rotary head has a first portion, in particular a threaded tool joint, followed by a second, recessed portion forming an outer collar at the transition between both portions, the first clamping means being provided underneath said tubular portion with a drill pipe elevator protruding inwards with respect to the inner surface of the tubular portion to engage the drill pipe underneath said collar, the drill pipe elevator being generally horseshoe-shaped enabling the recessed portion of the drill pipe to be inserted laterally in the drill pipe elevator when laterally inserting the drill pipe into the first clamping means.

6. The drill rig assembly according to claim 5, wherein adjacent said first portion, the recessed portion of the extremity of the drill pipe arranged to be coupled to the rotary head has a polygonal outer surface, while the drill pipe elevator has a polygonal inner surface corresponding to the polygonal outer surface in the recessed portion of the drill pipe.

7. The drill rig assembly according to claim 1, wherein said tubular portion has a longitudinal axis which substantially coincides with the rotation axis of the rotating part of the rotary head.

8. The drill rig assembly according to claim 1, wherein said first clamping means are mounted on the rotating part of the rotary head.

9. The drill rig assembly according to claim 8, wherein said second clamping means are mounted on the fixed part of the rotary head and comprise a clamping element arranged to engage the extremity of the drill pipe through said longitudinal slot in the tubular portion of the first clamping means.

10. The drill rig assembly according to claim 9, wherein said second clamping means comprises a support structure onto which said clamping element is mounted and which enables to insert the extremity of the drill pipe laterally into the first clamping means when these first clamping means are rotated to have the longitudinal slit in the tubular portion thereof turned away from said clamping element.

11. The drill rig assembly according to claim 1, wherein said second clamping means comprise a hydraulic cylinder-piston mechanism or a mechanical clamping mechanism arranged to clamp the extremity of the drill pipe against the first clamping means.

12. A clamping assembly for use in the drill rig assembly as claimed in claim 1, comprising first and second mutually co-operating clamping means to clamp the drill pipe between them, the first clamping means comprising a tubular portion arranged to partially enclose the extremity of the drill pipe to be clamped therein and having a longitudinal slit enabling said extremity of the drill pipe to be inserted laterally into this tubular portion, said first clamping means being in particular arranged to be mounted onto the rotating part of the rotary head whilst the second clamping means being in particular arranged to be mounted onto the fixed part of the rotary head.

13. The drill rig assembly according to claim 1, wherein said angle is greater than 180°.

14. The drill rig assembly according to claim 6, wherein the polygonal inner surface of the drill pipe elevator extends over such an angle that when the drill pipe is lowered so that the drill pipe elevator extends around the polygonal outer surface in the recessed portion of the drill pipe, the drill pipe is prevented from moving laterally out of the drill pipe elevator.

* * * * *